US008056830B1

(12) United States Patent
Pedersen

(10) Patent No.: US 8,056,830 B1
(45) Date of Patent: Nov. 15, 2011

(54) SPINNER TIP SHOWER HEAD

(76) Inventor: Jeff M Pedersen, Tacoma, WA (US)

( * ) Notice: Subject to any disclaimer, the term of this patent is extended or adjusted under 35 U.S.C. 154(b) by 117 days.

(21) Appl. No.: 12/651,898

(22) Filed: Jan. 4, 2010

Related U.S. Application Data

(60) Provisional application No. 61/142,236, filed on Jan. 2, 2009.

(51) Int. Cl.
*B05B 3/02* (2006.01)
*F23D 11/04* (2006.01)

(52) U.S. Cl. ..... 239/222.13; 239/227; 239/251; 239/225.1

(58) Field of Classification Search ..... 239/222.13, 239/227, 222.11, 223, 225.1, 233, 251
See application file for complete search history.

(56) References Cited

U.S. PATENT DOCUMENTS

| | | | | |
|---|---|---|---|---|
| 2,874,001 | A | 2/1959 | Webb | |
| 4,052,002 | A | 10/1977 | Stouffer et al. | 239/4 |
| 4,151,955 | A | 5/1979 | Stouffer | 239/11 |
| 4,369,850 | A * | 1/1983 | Barker | 175/393 |
| 4,795,094 | A * | 1/1989 | Correard | 239/229 |
| 4,848,671 | A | 7/1989 | Saurwein | 239/587 |
| 5,533,673 | A * | 7/1996 | Wilson et al. | 239/227 |
| 6,050,508 | A | 4/2000 | Fan | 239/587.1 |
| 6,360,965 | B1 * | 3/2002 | Clearman et al. | 239/222.19 |
| 6,422,480 | B1 * | 7/2002 | Richmond | 239/10 |
| 6,883,732 | B2 * | 4/2005 | Hasegawa | 239/416.5 |
| 7,530,474 | B2 * | 5/2009 | Amron | 222/79 |
| 2009/0057443 | A1 * | 3/2009 | Sendo | 239/405 |

* cited by examiner

*Primary Examiner* — Dinh Nguyen
*Assistant Examiner* — Jennifer Gordon
(74) *Attorney, Agent, or Firm* — Dean Craine

(57) ABSTRACT

A shower head designed to produce a consistent, wide diameter spray of water under both high and low water pressure conditions. The shower head includes a spinner tube mounted inside a cylindrical-shaped nozzle body. The upper segment of the spinner tube is held in a central location inside the nozzle body by a fixed cassette assembly. The middle and lower segments of the spinner tube extend below the cassette assembly and are bent outward and axially offset from the upper segment and from each other so that the spinner tube is able to spin freely inside the nozzle body. Mounted inside and over the upper end opening of the nozzle tube is an adapter with a longitudinally aligned threaded cavity formed on one end. The adapter includes a water orifice that delivers water from the shower head fixture tube to to the spinner tube. Disposed between the adapter and the upper end of the spinner tube is a flat washer with a narrow water orifice that delivers a narrow, high velocity stream of water to the spinner tube.

4 Claims, 2 Drawing Sheets

SPINNER TIP SHOWER HEAD

This utility patent application is based on and claims the filing date benefit of the U.S. Provisional patent application (Ser. No. 61/142,236), filed on Jan. 2, 2009.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to shower heads and more particularly to shower heads designed to produce a wide, conical water spray pattern during low or high water pressure conditions.

2. Description of the Related Art

A wide variety of shower heads that provide pulsating or non-pulsating streams of water are known in the art. Most shower heads are also adjustable which provide a wide variety of flow patterns. Unfortunately, when the water pressure is relatively low (below 30 P.S.I.) the size of the spray pattern is destroyed.

Some shower heads design to create large spray patterns are relatively large structures comprised of large flat, circular structures with perforations or large bulbous structures with internal impellers or rotators that rotate or wobble when water flows through them. Unfortunately, many homeowners find large shower heads visibly distracting.

SUMMARY OF THE INVENTION

It is an object of the present invention to provide a shower head capable of producing a wide, conical water spray pattern when there is low or high water pressure conditions.

It is another object of the present invention to provide such a shower head that is relatively small and has the general size and appearance of the shower head water pipe.

These and other objects are met by the shower head disclosed herein designed to attach to a standard shower head water pipe that produces a conical water spray pattern under both high and low water pressure conditions. The shower head includes a cylindrical-shaped nozzle body with a central bore formed therein. Disposed at the upper end of the nozzle body, is an adapter that includes a longitudinally aligned threaded cavity that connects to the external threads on a standard shower head water pipe. The adapter includes a water orifice that enables water delivered from the shower head water pipe to be delivered to a flat washer located below the adapter. The flat washer includes a narrow central opening with a diameter less than the adapter thereby reducing the diameter and increasing the velocity of the stream of water passing through the shower head.

Located inside the central bore of the nozzle body is a rotating hollow, outward bent spinner tube. The spinner tube is made up of three integrally formed segments—an upper segment, a middle segment and a lower segment. The upper segment is located in the upper end of the nozzle body and is held in a central, axially aligned position inside the nozzle body by a cassette assembly. The cassette assembly includes an alignment tube, an upper bearing, a lower bearing and a spacer tube. The upper and lower bearings are mounted on the upper and lower ends of the alignment tube upper segment of the spinner tube. Each bearing includes a center bore through which the upper segment of the spinner tube extends. The two bearings hold the upper segment in a longitudinally aligned position inside the center bore and allow the spin tube to rotate freely.

The middle and lower segments extend inside the central bore of the nozzle body and below the cassette assembly. The middle segment is bent outward from the longitudinal axis of the upper segment. During use, the angular orientation and length of the middle section controls the overall size of the water spray cone produced by the nozzle. By changing the orientation and length of the middle section, the overall size of the water spray cone may be adjusted. The lower segment is also offset from the axis of the middle segment and designed to create rotation spin. By increasing the angular orientation of the lower segment, the rate of rotation may be increased. In all cases, the angular orientation of the middle and lower segments and their lengths must be sufficient so that when water is delivered to the spinner tube, the spinner tube is able to spin freely inside the nozzle body under either high or low pressure conditions.

DESCRIPTION OF THE PREFERRED EMBODIMENT(S)

Referring to the FIGS. 1-6, there is shown a shower head 10 disclosed herein designed to be attached to a standard shower head water pipe 90 that produces a consistent, wide, conical-shaped spray pattern 100 under both high and low water pressure conditions.

Figure 1:
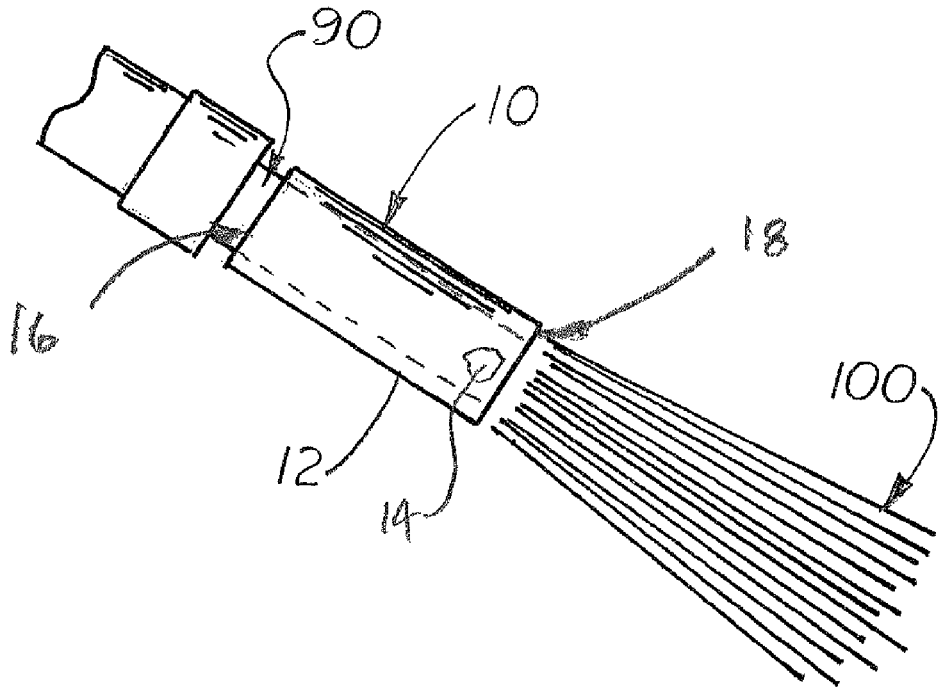
FIG. 1 is a side elevational view of the spinner tip shower head attached to a shower head water pipe.
Figure 2:
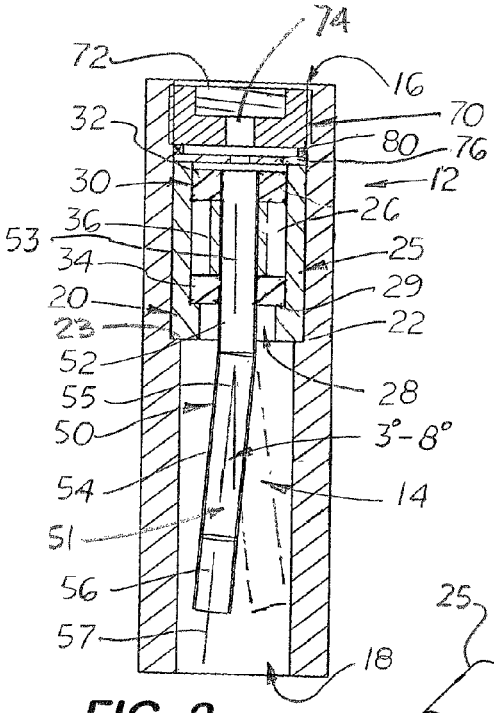
FIG. 2 is a sectional, side elevational view of the spinner tip shower head.
Figure 3:
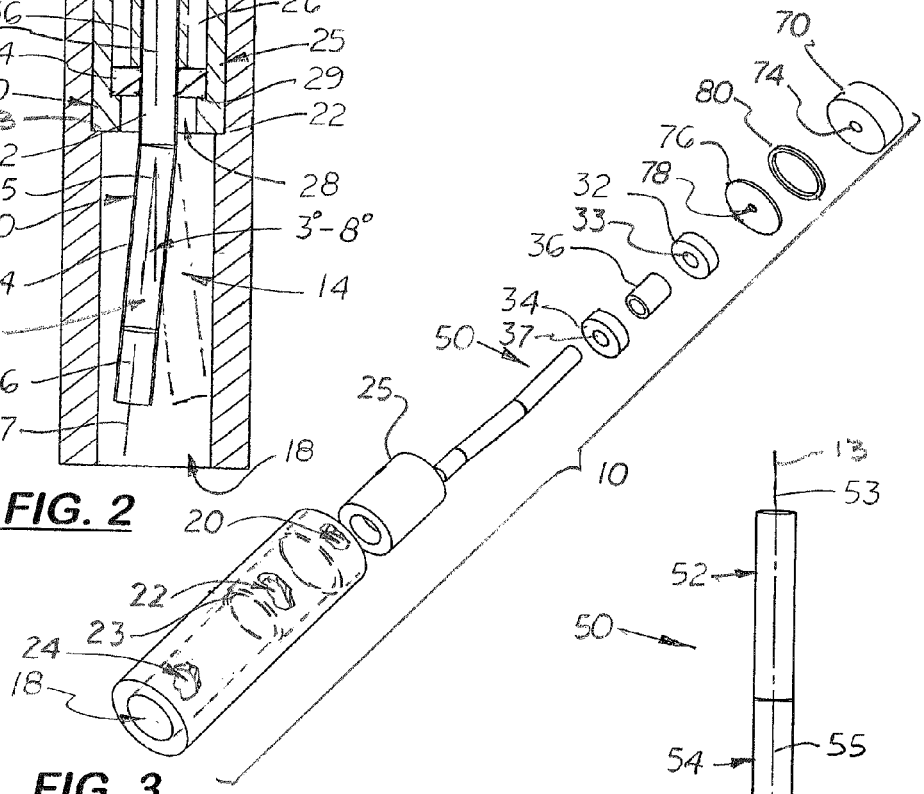
FIG. 3 is an exploded perspective view of the spinner tip shower head.
Figure 6:
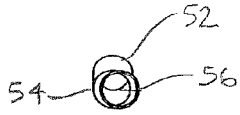
FIG. 6 is a lower end view of the spinner tube.

The shower head 10 includes a cylindrical, elongated nozzle body 12 with a central bore 14 that extends substantially the full length of the nozzle body 12. Formed on the opposite ends of the nozzle body 12 is a top opening 16 and a lower opening 18. As shown in FIG. 3, formed inside the upper ⅓ section of the nozzle body 12 is a wide cylindrical-shaped upper cavity 20. Located below the upper cavity 20 is a smaller diameter, cylindrical-shaped middle cavity 22 designed to house a cassette assembly 25 also described further below. Formed below the middle cavity 22 is a longer, smaller diameter, cylindrical-shaped lower cavity 24. The middle and lower cavities 22, 24, respectively, are separated by a shoulder 23.

Disposed inside the upper cavity 20 is an adapter 70 designed to connect to a standard shower head water pipe 90 (typically a ½ pipe with an external threaded end) that delivers both hot and cold water to the user. The adapter 70 includes a longitudinally aligned threaded cavity 72 formed on its upper end and a longitudinally aligned small diameter water passageway 74. During assembly, the internal threads formed on the cavity 72 are connected to external threads formed on the end of the water pipe 90.

Longitudinally aligned and disposed below the adapter 70 is an o-ring 80. Located below the o-ring 80 is a flat washer 76. The flat washer 76 includes a narrow, centrally aligned orifice 78 smaller in diameter than the water passageway 74 formed on the adapter 70. During assembly, the flat washer 76 is aligned with the adapter 70 so that the orifice 78 is coaxially aligned with the water passageway 74 on the adapter 70. During use, the stream of water passes through the water passageway 74 and then through the orifice 78. Because the orifice 78 is smaller than the water passageway 74, the velocity of the stream of water increases.

Disposed inside the nozzle body 12 below the flat washer 76 is a rotating spinner tube 50. The spinner tube 50 includes an upper segment 52, a middle segment 54, and a lower segment 56. The end of the upper segment 52 is located just below the orifice 78 on the flat washer 76 and held in central, axially aligned position inside the nozzle body 12 by a cassette assembly 25. The cassette assembly 25 includes an outer alignment tube 26, an upper bearing 32, a lower bearing 34 and a spacer tube 36 and located inside the alignment tube 26. The upper and lower bearings 32, 34 are mounted adjacent to the upper and lower ends of the alignment tube 26. Each bearing 32, 34 includes a center bore 33, 35, respectively, through which the upper segment 52 of the spinner tube 50 extends. The two bearings 32, 34 are fixed structure and designed to hold the upper segment 52 in a longitudinally aligned position inside the upper cavity 20 and to allow the spinner tube 50 to rotate freely. When assembled, the lower end of the alignment tube 26 is designed to rest against the shoulder 23 formed between the middle and lower cavities 22, 24, respectively. The spacer tube 36 is used to keep the two bearings 32, 34, in a spaced apart location inside the alignment tube 26.

When assembled, the cassette assembly 25 is placed inside the middle cavity 22. The lower edge of the cassette assembly 25 rests against the shoulder 23. The exposed end of the upper segment 52 is flush with the upper surface of the upper bearing 32. The longitudinal axis 13 of the upper segment 52 is coaxially aligned with the longitudinal axis of the nozzle body 12.

During use, the narrow stream of water flows directly into the upper section 22 segment 52 is a narrow stream of water. The middle and lower segments 54, 56, respectively, extend below the cassette assembly 25 and are designed to convert the stream of water into a conical-spray by re-positioning the exit port for the stream of water in a diagonal offset position relative to the nozzle body's longitudinal axis 13 and re-positioning the exit port so that rotational force is created that causes the spinner tube 50 to rotate inside the nozzle body 12.

Figure 4:
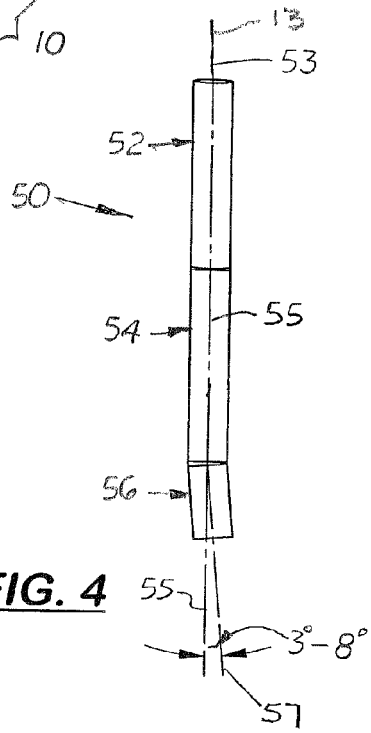
FIG. 4 is a side elevational view of the spinner tube.
Figure 5:
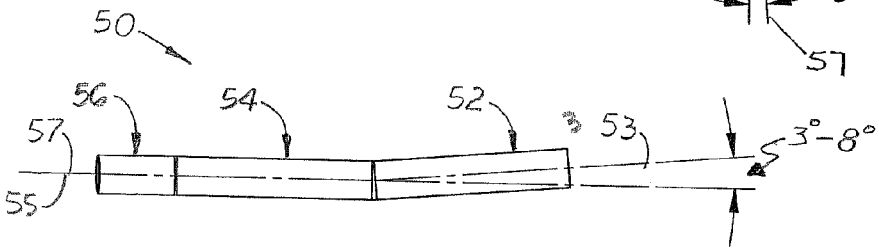
FIG. 5 is a front elevational view of the spinner tube.

As shown in FIG. 4, the longitudinally axis 55 of the middle segment 54 of the spinner tube 50 is bent diagonally outward and downward 3 to 8 degrees from the uppers upper segment's longitudinal axis (indicated by reference number 53). During assembly, the angular orientation and length of the middle segment 54 is adjusted to control the overall size of the water spray cone produced by the nozzle. Ideally, the size of the water spray cone should be approximately 10 to 12 inches in diameter 18 to 24 inches from the end of the nozzle.

Rotational force is created on the spinner tube 50 by the angular orientation of the lower segment 56 with respect to the longitudinal axis 55 of the middle segment 54. The longitudinal axis 53, 57 of the upper and lower segments 52, 56, respectively, are offset. More specifically, the plane defined by the axis 55 of the middle segment 54 and the axis 57 of the lower segment 56 is perpendicular to the plane defined by the axis 53 of the upper segment 52 and the axis 55 of the middle segment 54. The lengths and angles of the middle and lower segments 54, 56, respectively, are sufficient so that when water is delivered to the spinner tube 50, the spinner tube 50 is able spin freely inside the nozzle body 12. In the preferred embodiment, the length of the lower segment 56 is slightly less then the distance from the lower opening 18 of the nozzle body 12 and the lower bearing 34 so that the lower end of spinner tube 50 is hidden and protected from damage.

During setup, the adapter 70 is attached to the shower head water pipe 90. When the water faucet is turned on, water begins to flow into the adapter 70 and through the orifice 78 formed on the flat washer 76. Because the orifice 78 on the washer 76 is narrow, the water velocity is increased. The stream of water then travels into the top opening in the spinner tube 50 and out of the lower segment 56. Because the spinner tube 50 is diagonally bent outward and offset from the upper segment 52 and the nozzle body 12, the spin tube 50 begins to spin as the stream of water flows out of the lower opening 18.

In the embodiment shown, the nozzle body 12 is approximately 4 inches in length and the center bore 18 is approximately ¾ inch in diameter. The water passageway 74 in the adapter 70 is approximately 3/16 to 7/16 inches in diameter. The flat washer 76 is approx ¾ in diameter and the center bore 78 is approximately 5/32 to 3/16 inches in diameter. Preferably, the center bore 78 in the flat washer 76 is less than the center bore water passageway 74 formed in the adapter 70.

The spinner tube 50 has an overall length of approximately 3 inches with a center bore 51 of approximately 7/16 inches in diameter. The upper segment 52 measures approximately 1¼ inch in length, the middle segment 54 measures approximately 1¼ inches in length, and the lower section 56 measures approximately ½ inch in length.

The shower head 10 is designed to be used in water pressure conditions ranging from low (10 psi) to high (psi). The amount of spray force may be adjusted by the hot and cool water controls. The amount of spray force may also be adjusted by exchanging the flat washers 76 with different size orifices 78. For example, a flat washer 76 with a smaller bore (5/32 inch) may be desirable in low water pressure conditions, and a flat washer 76 with a larger orifice 78 (3/16 inch) may be desirable in high water pressure conditions It should be understood that the cassette assembly 25 could be replaced by a cylindrical bushing with low friction washers or rings at its opposite ends that hold the upper segment 52 longitudinally aligned inside the center bore. It should also be understood that the spacer tube 36 could be eliminated and the nozzle body 12 could be modified to receive the two upper and lower bearings, 32, 34, respectively. The shoulder 23 could also be eliminated and replaced with other structures that hold the flat washer 76 and the upper and lower bearings 32, 34 in a fixed position inside the nozzle body 12.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A low to high water pressure shower head, comprising:

a a hollow, cylindrical-shaped nozzle body with a threaded top opening and a central bore formed therein;

b. an adapter located inside said nozzle body and attached to said top opening on said nozzle body, said adapter also includes a central water passageway that allows water delivered to said adapter to be transmitted through said adapter;

c. a flat washer located inside said nozzle body and below said adapter, said flat washer includes a central orifice slightly smaller that said water passageway formed on said adapter; and, d. a rotating spinner tube located inside central bore in said nozzle body, said spinner tube includes an upper segment, middle segment, and a lower segment, said upper segment being longitudinally aligned inside said central bore, said middle segment being outward and diagonally aligned with said upper segment, and said lower segment be radially aligned with said middle section so that a rotation force is exerted on said spinner tube when water is forced from said lower segment, said middle segment being bent outward 3 to 8 degrees from said upper segment, said lower segment being outward 3 to 8 degrees from said middle segment, said middle segment and said lower segment being sufficient in length so that said spinner tube may rotate freely inside said central bore of said nozzle body.

2. The shower head, as recited in claim 1, further including an o-ring seal located inside said nozzle body and between said adapter and said flat washer.

3. The shower head, as recited in claim 1, further including an upper bearing and a lower bearing located inside said nozzle body and used to hold said upper segment of said spinner tube in a longitudinally aligned position in said nozzle body.

4. The shower head, as recited in claim 1, wherein said upper segment is held in said nozzle body by a cassette assembly that includes an upper bearing, a lower bearing, an outer alignment tube, and a spacer tube.

* * * * *